United States Patent [19]

Nijman

[11] 4,264,118

[45] Apr. 28, 1981

[54] INSULATION-PIERCE AND CRIMP TERMINATION AND METHOD FOR EFFECTING SAME

[75] Inventor: John P. Nijman, Scarborough, Canada

[73] Assignee: Bunker Ramo Corporation, Oak Brook, Ill.

[21] Appl. No.: 42,465

[22] Filed: May 25, 1979

Related U.S. Application Data

[63] Continuation of Ser. No. 897,076, Apr. 17, 1978, abandoned.

[51] Int. Cl.[3] ..... H01R 4/24

[52] U.S. Cl. ..... 339/99 R; 339/97 C; 339/276 T

[58] Field of Search ..... 339/97, 98, 99, 276 T

[56] References Cited

U.S. PATENT DOCUMENTS

| | | | |
|---|---|---|---|
| 2,648,050 | 8/1953 | Berg | 339/97 |
| 2,680,235 | 7/1954 | Pierce | 339/97 |
| 2,873,434 | 2/1959 | Drum et al. | 339/97 |
| 3,273,102 | 9/1966 | Cobaugh | 339/18 |
| 3,715,457 | 2/1973 | Teagno | 339/95 R X |
| 3,753,213 | 8/1973 | Frey | 339/97 R |
| 3,798,347 | 3/1974 | Harding | 339/97 C X |
| 3,826,861 | 7/1974 | Karl et al. | 339/276 R X |
| 3,867,005 | 2/1975 | Hoppe, Jr. | 339/98 |
| 3,902,154 | 8/1975 | McKee | 339/223 R |
| 3,924,057 | 12/1975 | Sosinski | 339/276 R X |
| 3,934,075 | 1/1976 | Dilliplane | 339/223 R X |
| 3,937,403 | 2/1976 | Lawson | 339/97 C |
| 3,947,082 | 3/1976 | Bender | 339/97 R |
| 3,959,868 | 6/1976 | Mathe | 29/629 X |
| 3,964,815 | 6/1976 | McDonough | 339/97 C |
| 4,082,402 | 4/1978 | Kinkaid | 339/97 C |

*Primary Examiner*—John McQuade
*Assistant Examiner*—John S. Brown
*Attorney, Agent, or Firm*—F. M. Arbuckle; J. R. Hoffman

[57] ABSTRACT

An electrical connector and termination tool are disclosed for making crimped, insulation-piercing terminations with insulation covered conductors. The connector includes a dielectric insert, a plurality of electrical contacts mounted in the insert and an access passage for insertion of a termination tool to effect the crimp-pierce termination in situ. The termination tool has a bifurcated termination head including separate insertion and crimping members which are used sequentially to first press the conductor into the terminal portion of the contact and then to crimp the contact over the conductor to complete the termination.

18 Claims, 6 Drawing Figures

FIG. 2
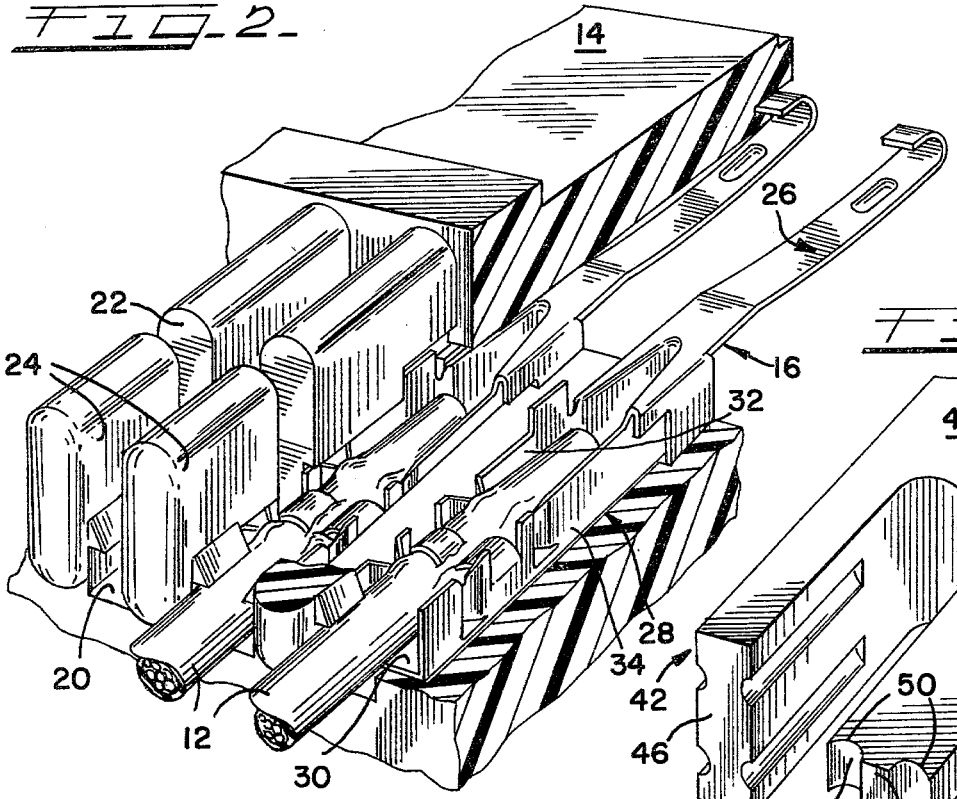
FIG. 4
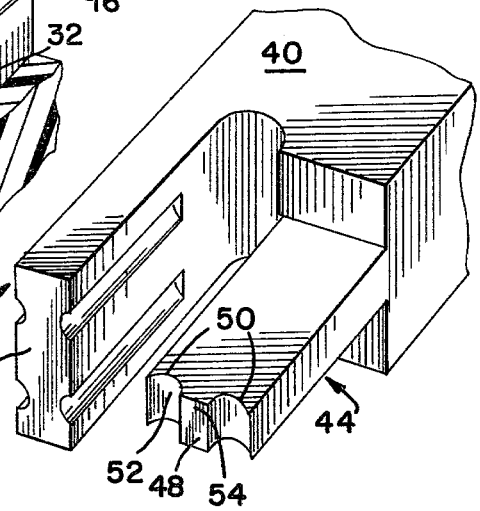
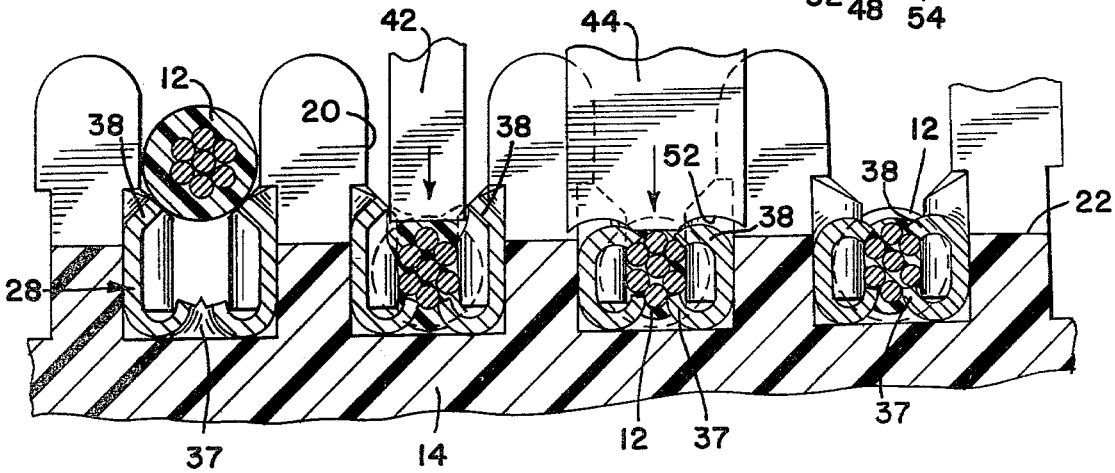
FIG. 3

INSULATION-PIERCE AND CRIMP TERMINATION AND METHOD FOR EFFECTING SAME

This is a continuation of application Ser. No. 897,076 filed Apr. 17, 1978 and now abandoned.

BACKGROUND OF THE INVENTION

The present invention is directed generally to solderless electrical connections and, more particularly, to a novel electrical connector including a contact for forming a crimped, insulation-piercing electrical connection and method and a termination tool used to effect such a connection.

In recent years, increasing numbers of applications have developed in the communications, data processing and transportation industries requiring electrical connectors which provide reliable solderless interconnections with insulated electrical conductors. This demand has perhaps been greatest in the telecommunications industry where miniaturized, high contact density ribbon connectors are used extensively. Connectors of this general type are disclosed in U.S. Pat. Nos. 3,867,005; 3,902,154; and 3,926,498. Because of the great number of individual conductors terminated in these connectors and because of the close spacing between the individual contacts, reliable solder terminations are difficult to achieve, as well as time consuming and costly to maintain and service. For these reasons insulation-piercing contacts have been developed for use in ribbon connectors and have met with wide acceptance when used to terminate insulated conductors having solid wire cores. Unfortunately, due to the demanding standards in the industry requiring almost negligible change in contact resistance, the insulation-piercing type ribbon connectors have proven unacceptable when used with stranded wire core conductors. Experience has shown that tensile forces applied to the conductors, as well as the cold flow of the insulation surrounding the core, causes the individual strands of the wire core to move and reposition within the insulation-piercing contacts, causing changes in contact resistance. Thus, solder termination ribbon connectors are still used with stranded core insulated conductors.

Accordingly, a need exists for a ribbon connector which provides a satisfactory solderless termination to stranded core insulated conductor, and preferably both stranded and solid core conductors. In addition, in order that the connector be commercially practicable, the termination must be performed with the electrical contact premounted within the connector.

SUMMARY OF THE INVENTION

The present invention, therefore, is directed to an electrical connector including means to effectively and reliably terminate both solid and stranded wire core insulated conductors in an insulation-piercing contact, without the need for any soldering operation, and while the contacts are assembled within the connector.

In accordance with one embodiment of the invention, the electrical connector generally comprises a dielectric insert, a plurality of electrical contacts and means providing access to the contacts for effecting the crimped, insulation-piercing termination. The contacts each include a terminal portion with opposed side walls mounted within a cavity of the insert, and the access means comprises a passageway in the insert which accommodates a crimp tool used to shear and deform the side walls of the contact terminal and secure the conductors in termination position within the contacts.

The invention is further directed to a unique method of termination carried out in situ within the connector whereby the conductor is first inserted into the contact member to effect the electrical interconnection and then crimped in place by shearing a segment of the contact member and folding the sheared segment over the inserted conductor.

The invention is also directed to a novel tool used to interconnect both solid and stranded core insulated conductors with the connector by means of a crimped, insulation-piercing termination. The tool generally comprises a bifurcated termination head including an insertion member and a crimping member. The insertion member has an elongated and generally planar end face for engaging and pressing a longitudinal portion of the conductor into insulation-piercing and electrical engagement with the terminal portion of the contact. The crimping member has an end face including means for cutting portions of the contact side walls and folding the sidewall portions onto the conductor to mechanically retain the conductor in insulation-piercing electrical engagement with the contact terminal portion.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIG. 2 is a fragmentary perspective view of the connector of FIG. 1 with portions broken away to illustrate the crimp-pierce termination obtained with the present invention;

FIG. 3 is a fragmentary cross-sectional view illustrating the sequence of steps performed to obtain the desired crimp-pierce termination;

FIG. 4 is a perspective view illustrating a preferred termination tool made in accordance with the present invention;

DETAILED DESCRIPTION OF THE INVENTION

Figure 1:
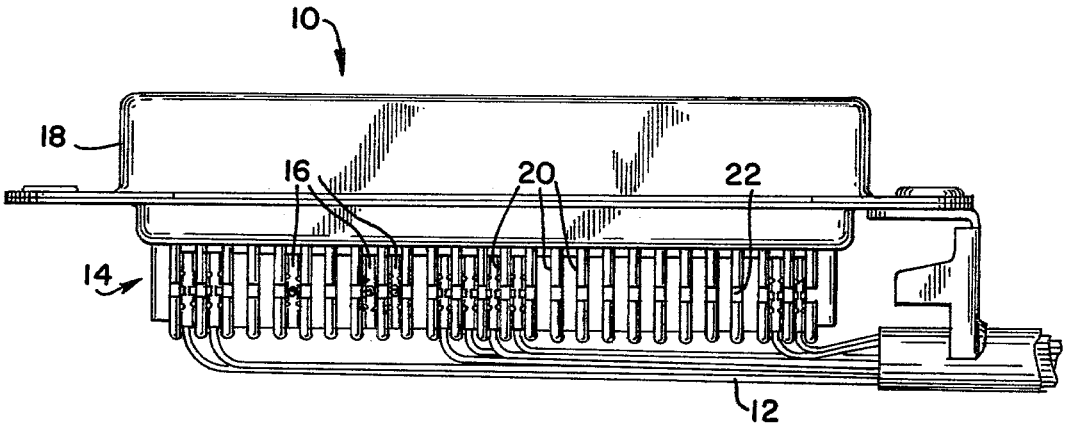
FIG. 1 is a side elevational view of an electrical connector embodying the features of the present invention and showing the individual conductors of a multi-conductor electrical cable terminated therein.

With reference to the drawings, and specifically FIG. 1, an electrical connector 10 is shown with individual insulated conductors 12 terminated to each of the connector's electrical contacts. The connector 10 is a ribbon connector and comprises a dielectric insert 14, a plurality of electrical contacts 16 mounted in the insert, and a metal skirt 18 which houses the insert and contacts subassembly. A detailed description of the structure and function of ribbon connectors and their components is provided in U.S. Pat. Nos. 3,867,005 and 3,926,498 the disclosures of which are incorporated herein by reference. The insert 14 includes a plurality of elongated contact-receiving cavities 20 and an access passageway in the form of a slot 22 extending transversely to the cavities 20. The slot 22 provides access to the electrical contacts 16 to permit crimp-pierce termination of the conductors 12 as described in greater detail below.

Referring now to FIG. 2, the subassembly comprising insert 14 and contacts 16 is shown in greater detail. The insert includes a plurality of partitions or upstanding barriers 24 which form the sides of the contact-receiving cavities 20. Each of the contacts 16 has an active contact portion 26 adapted to electrically engage a compatible contact and a terminal portion 28 for electrically and mechanically engaging the insulated conductors 12. In the illustrated embodiment, the terminal portion 28 of each contact is channel-shaped, having a bottom wall 30 and opposed side walls 32 and 34, and includes insulation-piercing means which serve to provide the electrical and mechanical engagement with a conductor inserted and pressed into the channel.

In accordance with the present invention, the insert 14 is designed to permit crimping of the terminal portion 28 while the contacts 16 are mounted in place in the connector. To accomplish this end, the slot 22 is formed in each barrier 24 to provide access for a crimping tool. The slot 22 need not extend to the base of cavity 20 but must terminate at a point below the top of the side walls 32 and 34 of the contact terminal portion 28. In other words, the side walls 32 and 34 extend upwardly into the slot 22. As shown in FIG. 3 the crimp tool is inserted into the cavity 20 along a path of travel generally perpendicular to the terminal portion 28 and acts to shear and deform a segment of the side walls 32 and 34 coincident with the slot 22 to hold the conductor 12 in final terminated position.

Figure 5:
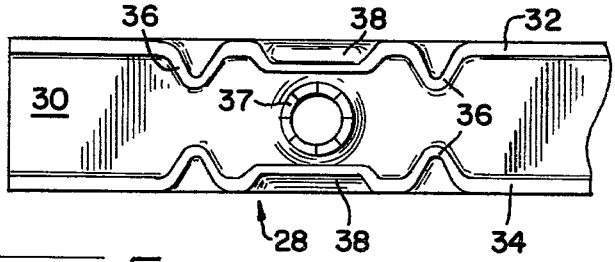
FIG. 5 is a plan view of the terminal portion of a preferred contact member used in the , connector illustrated in FIG. 1.
Figure 6:
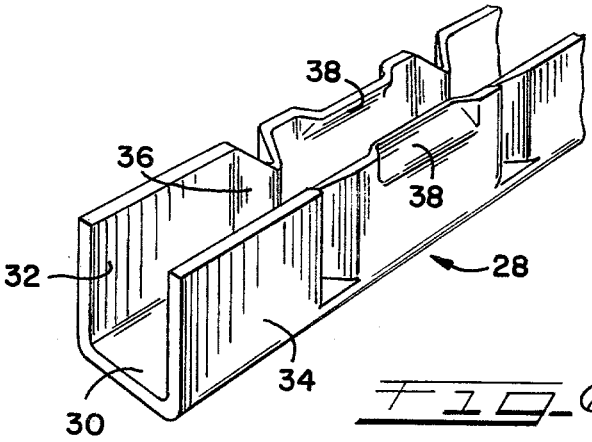
FIG. 6 is a perspective view of the contact member of FIG. 5.

A preferred configuration for the terminal portion 28 is illustrated in FIGS. 3, 5, and 6. In accordance with this embodiment, the side walls 32 and 34 include conventional insulation-piercing protuberances or detents 36 whose structure and function are well known in the art. In addition, the terminal portion 28 of the contact includes a further insulation-piercing extrusion in the bottom wall 30. In the illustrated embodiment, the extrusion is an upstanding cone 37. The side walls also include inwardly extending, offset upper edges 38 which form a lead-in for the crimp tool. The detents 36 are positioned longitudinally on the sidewalls 32 and 34 remote from the slot 22 of insert 14 and their function and operation remain substantially the same as in prior art connectors. The cone 37 and edges 38 are positioned coincident with the slot 22 and serve to improve both the mechanical and electrical characteristics of the termination. As the conductor is pressed into the terminal portion of the contact, the cone 37 pierces the conductor's insulation and engages the conductor core. Likewise, as the walls 32 and 34 are deformed by the crimp tool, the edges 38 pierce the conductor's insulation and also engage the conductor core. Thus, in the illustrated embodiments electrical contact is made at the sides, top and bottom of the conductor via the detents 36, cone 37 and edges 38. In addition, mechanical retention of the conductor within the contact is enhanced, and the opportunity for movement of even stranded core conductors is thereby minimized.

A preferred termination tool is illustrated in FIG. 4 and includes a bifurcated termination head 40 having separate insertion and crimping members, 42 and 44 respectively. The insertion member 40 has a generally planar end face 46 for engaging and pressing the conductor into electrical engagement with the terminal portion 28 of the contact 16. The crimping member 44 has a specially configured end face 48 including means for cutting portions of the contact's side walls 32 and 34 and means for crimping or folding these cut portions inwardly onto the conductor. In the illustrated embodiment, the cutting means are curved edges 50 which shear the side walls of the contact as the tool is inserted into the cavity 20, and the folding means are the curved surfaces 52 which meet at a central apex 54. It will be appreciated that as the insertion tool is inserted into cavity 20 to the full extent, the surfaces 52 will direct the cut portions of side walls 32 and 34 over and into the conductor, thereby crimping the contact and conductor in a fixed insulation-piercing termination.

In a conventional ribbon connector as many as twenty-five conductors will be terminated to twenty-five separate contacts on each side of the connector. Each of the conductors is aligned adjacent the terminal portion of a respective contact and then terminated by means of a suitable termination tool. The sequence of steps employed to effect a crimp-pierce termination with the connector and tool of the present invention are illustrated in FIG. 3. After the conductors have been aligned adjacent the appropriate contact terminal portions 28, the tool carrying head 40 presses each conductor into the terminal portion and then crimps the contact onto the conductor. Since the tool moves relative to the connector (right to left in FIG. 3) with each insertion, the insertion member 42 first seats the conductor within the contact and properly positions the conductor for the subsequent insertion of the crimping member 44. As can be clearly seen in FIG. 3 the crimping member 44 extends laterally beyond the side walls 32 and 34 of the contact, thereby necessitating the access passageway or slot 22. The slot 22 must have a depth sufficient to allow full insertion of the crimping member 44 to properly shear the side walls 32 and 34 and completely crimp the sheared portions over and into the conductor.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An electrical connector for terminating a plurality of insulated conductors comprising:

a dielectric insert including a plurality of elongated cavities and a slot extending transversely through said cavities; and a plurality of electrical contact members each including a terminal portion disposed within one of said cavities, said contact terminal portions receiving said insulated conductors and having insulation-piercing means for electrically engaging said conductors and sidewalls extending into said transverse slot, said sidewalls having shearable and deformable segments coincident with said slot;

whereby a crimp tool may be inserted into said slot to shear and deform the segments of said sidewalls adjacent said slot to hold the conductors in terminated position within said contact terminal portions.

2. The electrical connector of claim 1 wherein each said contact terminal portion further includes a bottom wall having an insulation-piercing means formed integrally therein and located generally coincident with said transverse slot.

3. The electrical connector of claim 1 wherein each said contact terminal portion also includes at least one pair of inwardly extending insulation-piercing means formed integrally in said side walls and located remote from said transverse slot.

4. The electrical connector of claim 1 wherein each said contact terminal portion further includes a bottom wall having an upwardly extending insulation-piercing extrusion formed integrally therein and located generally coincident with said transverse slot.

5. The electrical connector of claim 1 wherein each of said contact terminal portion further includes two pairs of inwardly extending insulation-piercing means formed integrally in said side walls and located remote from and on opposite sides of said transverse slot.

6. An electrical connector for terminating a plurality of insulated conductors comprising:

a dielectric insert including a plurality of elongated cavities in one surface thereof separated by partition means and access means in said surface extending transverse to said cavities through said partition means; and a plurality of electrical contact members each having a channel-shaped conductor-receiving terminal portion disposed within one of said cavities, said contact terminal portions having substantially continuous side walls which extend into said access means but terminate below said surface;

whereby a crimp tool may be inserted into said access means to shear and deform the portion of said side walls adjacent said access means into insulation-piercing engagement with conductors disposed within said contact terminal portions.

7. The electrical connector of claim 6 wherein said terminal portion side walls are of generally uniform height.

8. An electrical connector for terminating a plurality of insulated conductors comprising:

a dielectric insert including a plurality of elongated cavities and a slot extending transversely through said cavities; and a plurality of electrical contact members each including a terminal portion disposed within one of said cavities, said terminal portions having means for piercing the insulation of said conductors to make an electrical connection therewith and deformable means extending into said transverse slot for engaging the insulated conductors disposed within said terminal portions to hold said conductors therein and in electrical connection with said insulation-piercing means.

9. An electrical connector for terminating a plurality of insulated conductors comprising:

a dielectric insert including a plurality of elongated cavities and a slot extending transversely through said cavities; and a plurality of electrical contact members each including a terminal portion disposed within one of said cavities, said contact terminal portions being adapted to receive said insulated conductors and having sidewalls extending upwardly into said transverse slot, said contact terminal portions also including at least one pair of inwardly extending insulation-piercing means formed integrally in said sidewalls and located remote from said transverse slot;

whereby a crimp tool may be inserted into said slot to deform the portions of said sidewalls adjacent said slot to hold the conductors in terminated position within said contact terminal portions.

10. An electrical connector for interconnecting electrical circuits including insulated conductors comprising:

a dielectric insert including a plurality of contact-receiving cavities;

a plurality of electrical contact members each having a terminal portion with opposed side walls disposed within one of said cavities;

means formed in said dielectric insert providing access to said side walls, said sidewalls extending into said access means whereby a crimp tool may be inserted into said access means to deform the portions of said side walls adjacent said access means to secure the conductors in terminated position within said contact terminal portions.

11. The electrical connector of claim 10 wherein said dielectric insert includes partition means defining said contact-receiving cavities and said access means comprises a passageway formed in said partition means.

12. The electrical connector of claim 11 wherein said partition means comprises a plurality of elongated upstanding barriers and said passageway comprises a slot extending transversely through said barriers.

13. The electrical connector of claim 10 wherein said contact terminal portion includes a bottom wall integral with said side walls and having an insulation-piercing means located generally coincident with said insert access means.

14. The electrical connector of claim 10 wherein said contact terminal portion comprises an elongated channel having continuous side walls along the entire length thereof, said side walls also having opposed inwardly extending insulation-piercing means located remote from said insert access means.

15. An electrical connector for interconnecting electrical circuits including insulated conductors comprising:

a dielectric insert including a plurality of contact-receiving cavities;

a plurality of electrical contact members each having a terminal portion with opposed sidewalls disposed within one of said cavities, said terminal portion also including at least one pair of insulation-piercing means formed integrally in said sidewalls; and access means formed in said dielectric insert, with said sidewalls extending into said access means, permitting selective deformation of portions of said sidewalls remote from said insulation-piercing means to secure the conductors in terminated position within said contact terminal portions.

16. The electrical connector of claim 15 wherein said dielectric insert includes partition means defining said contact-receiving cavities and said access means comprises a passageway formed in said partition means.

17. The electrical connector of claim 16 wherein said partition means comprises a plurality of elongated upstanding barriers and said passageway comprises a slot extending transversely through said barriers.

18. The electrical connector of claim 15 wherein said contact terminal portion includes a bottom wall integral with said side walls and having another insulation-piercing means located generally coincident with said access means.

* * * * *